US012203691B2

(12) United States Patent
Poole

(10) Patent No.: US 12,203,691 B2
(45) Date of Patent: Jan. 21, 2025

(54) MOULD

(71) Applicant: Presley Rain Limited, Erdington (GB)

(72) Inventor: Christopher Poole, Erdington (GB)

(73) Assignee: Presley Rain Limited, Erdington (GB)

( * ) Notice: Subject to any disclaimer, the term of this patent is extended or adjusted under 35 U.S.C. 154(b) by 194 days.

(21) Appl. No.: 17/942,456

(22) Filed: Sep. 12, 2022

(65) Prior Publication Data

US 2023/0078442 A1 Mar. 16, 2023

(30) Foreign Application Priority Data

Sep. 13, 2021 (GB) ..... 2113014

(51) Int. Cl.
*F25C 1/25* (2018.01)
*F25C 1/06* (2006.01)

(52) U.S. Cl.
CPC ..... *F25C 1/25* (2018.01); *F25C 1/06* (2013.01); *F25C 2301/00* (2013.01)

(58) Field of Classification Search
CPC ..... F25C 1/22; F25C 1/25; F25C 1/04; F25C 1/06; F25C 1/243; F25C 2301/00; F25D 2331/811; F25D 31/002; F25D 2303/081
See application file for complete search history.

(56) References Cited

U.S. PATENT DOCUMENTS 5,711,892 A * 1/1998 Ramirez ..... B44C 5/06 249/105
6,763,675 B1 * 7/2004 Fleeman ..... F25C 1/22 62/396
2009/0115109 A1 5/2009 Albright
2015/0021458 A1 * 1/2015 Zorovich ..... B29C 33/50 249/134
2015/0219390 A1 8/2015 Luther
2020/0173720 A1 * 6/2020 Alexander ..... F25D 31/002

FOREIGN PATENT DOCUMENTS

AU 2006201786 A1 11/2007

OTHER PUBLICATIONS

Search Report for GB2113014.1 dated Feb. 10, 2022.

* cited by examiner

*Primary Examiner* — Joseph F Trpisovsky
(74) *Attorney, Agent, or Firm* — Caesar Rivise, PC

(57) ABSTRACT

An ice luge mould (1), the mould (1) comprising a first part (2) and a complementary second part (3), the first part (2) and the second part (3) being configured to form an internal cavity therebetween when assembled, the mould (1) further comprising a water inlet (20) and a fluid-tight seal (21, 31) provided around the periphery of the first part (2) and second part (3) and a channel-former (32) configured to form a channel in the ice luge.

20 Claims, 9 Drawing Sheets

MOULD

CROSS-REFERENCE TO RELATED APPLICATIONS

This non-provisional application claims the benefit under 35 U.S.C. § 119(a) of British application no. GB2113014.1 filed on Sep. 13, 2021 entitled MOULD and whose entire disclosure is incorporated by reference herein.

BACKGROUND OF THE INVENTION

1. Field of Invention

This invention relates generally to a mould suitable for forming an ice luge. More specifically, although not exclusively, this invention relates to a reusable mould suitable for forming an ice luge (e.g. an ice luge mould), and methods of making the same.

2. Description of Related Art

Ice luges are popular for rapidly chilling beverages, for example, at parties and gatherings. Often, alcoholic beverages are served in ice luges such as spirits including vodka and tequila. However, non-alcoholic beverages may also be served in an ice luge.

Ice luges are blocks of sculpted or moulded ice containing one or more channels or lanes having an inlet at or towards the top of the ice luge, and an outlet towards the base of the ice luge, such that the channel or lane slope downwards. In use, a beverage is poured from the entrance of the channel. The liquid travels downwards through the channel, and is cooled as it contacts the ice, to emerge from the lower end of the channel thereby dispensing the liquid into a glass or other receptacle that is placed to receive the chilled beverage.

The fabrication of an ice luge depends on its size and complexity. Large, bespoke ice luges may be sculpted by hand, which requires a large commercial freezer to provide an appropriately sized block of ice, and significant time and labour costs. Smaller ice luge may be formed in a mould. However, often the mould is for single use only, which is wasteful and expensive if multiple ice luges are required.

SUMMARY OF THE INVENTION

It is therefore a first non-exclusive object of the invention to provide a mould suitable for fabricating an ice luge, wherein the mould is reusable.

Accordingly, a first aspect of the invention provides a two-part mould suitable for fabricating an ice luge, the mould comprising a first part and a complementary second part configured to form an internal cavity therebetween, the mould further comprising an aperture (e.g. an inlet or a water inlet) and a fluid-tight (e.g. watertight) seal provided around the (e.g. internal) periphery of the first and second part, and a channel former or channel-forming means configured to form a channel in the ice luge.

The first part of the mould and the second part of the mould may comprise body portions, inboard of the periphery. The respective body portions may be shaped to provide mould surfaces to provide a shaped ice luge.

Advantageously, the provision of a fluid-tight seal around the (e.g. internal) periphery of the first and second part enables the first part to be separated from the second part without damage. This enables the mould to be reused to form multiple ice luges.

In embodiments, the aperture (e.g. water inlet) may comprise an aperture located in one of the first part or the second part. In embodiments, the aperture (for example the water inlet) may comprise a valve, e.g. configured to allow water to enter but not to exit the cavity formed between the first part and the second part of the mould. In embodiments, the aperture (e.g. water inlet) may comprise an attachment, e.g. a hose, to enable water to be added to the cavity, e.g. from a tap. A stopper or plug may be provided to non-permanently close the inlet.

The aperture may extend through a body portion of the first part or second part.

In embodiments, the fluid-tight seal provided around the internal periphery may comprise a first part and a complementarily-shaped second part. For example, the fluid-tight seal may comprise a male member, e.g. located on the first or second part, and a female member, e.g. located on the second or first part. In embodiments, the male member may comprise one or more, e.g. one, two, three, or more, projections that extend continuously or non-continuously around the (e.g. internal) periphery, e.g. of the first part. In embodiments, the female member may comprise one or more, e.g. one, two, three, or more rebates that extend continuously or non-continuously around the (e.g. internal) periphery, e.g. of the second part. In embodiments, if plural projections are provided the projections may comprise a first projection part and a concentric second projection part and an n'th concentric projection part. One or more of the first projection part, second projection part or nth projection part may extend continuously or discontinuously. The rebates on the other part will correspond to effect a seal.

In embodiments, the rebates of the female member are sized and/or shaped and/or configured to receive the projections of the male member.

In embodiments, the fluid-tight seal comprises at least one male member located on the first part of the two-part mould, and at least one female member located on the second part of the two-part mould. In an embodiment, the male member may comprise two projections and the female member may comprise two rebates, wherein the rebates are sized and/or shaped and/or configured to receive the two projections to form the fluid-tight seal.

The male member may comprise a proximal part, where it is joined to the mould, and a distal part. The distal part may comprise a free edge and depending wall parts. The distal part (e.g. the free edge and one or more of the depending wall parts) may comprise or have formed thereon a seal material. The female member may comprise a channel formed from a base part and facing wall parts. The channel (e.g. the base part and/or one or more of the facing wall parts) may comprise or have formed thereon a seal material.

The seal material may be a thermoplastic elastomer (TPE) or a silicone rubber. The seal material may be bonded, welded, adhered, co-moulded or over-moulded to or with the male member (e.g. the distal part) and the female member (e.g. the channel part).

The TPE will be selected according to compatibility with the material of the male member (e.g. the distal part) and the female member (e.g. the channel part). The TPE may be selected from styrenic block copolymers (TPS), thermoplastic polyolefinelastomers (TPO), thermoplastic vulcanizates (TPV and TPSiV), thermoplastic polyurethanes (TPU), thermoplastic copolyesters (TPC), thermoplastic polyamides (TPA).

In embodiments, one or both of the first part and second part may comprise an upstanding wall that extends at least partially, e.g. completely, around the periphery of one or both of the first part and second part.

Advantageously, the upstanding wall provides a further sealing means to retain water inside the mould before it is frozen.

One or both of the first part and the second part may comprise a rim extending around its external periphery.

One or both of the first part and the second part may comprise one or more securements or securement means. For example, one or both of the first part and the second part may comprise more than 5, more than 10, more than 15 or more than 20 securement means. For example, one or both of the first part and the second part may comprise less than 30, less than 25, less than 20, less than 15 or less than 10 securement means. For example, one or both of the first part and the second part may comprise 1, 2, 3, 4, 5, 6, 7, 8, 9, 10, 11, 12, 13, 14, 15, 16, 17, 18, 19 or 20 securements means. The number of securement means may be chosen dependent on the overall size of the mould.

The securements or securement means may be a fastener, for example a clip, catch, hook or the like, to further secure the first part of the mould to the second part of the mould.

A first end of the securement means may be attached to the first part of the mould. A first end of the securement means may be attached to the second part of the mould. The or each securement means may be attached/located on the upstanding wall of one or both of the first part and the second part.

The or each securement means may be evenly distributed around the periphery of one or both of the first part and the second part. The or each securement means may be unevenly distributed around the periphery of one or both of the first part and the second part.

In an embodiment the securement means, e.g. fastener, e.g. clip, catch, hook or the like, comprises a male protruding member. The or each male protruding member may be configured to fasten over a portion, for example a rim, that extends around the external periphery of the opposing part of the mould. For example, a first end of the securement means may be attached to the first part of the mould and the male protruding member may be configured to fasten over the rim that extends around the external periphery of the second part of the mould, and vice versa.

In embodiments, one or both of the first part and the second part may comprise a protrusion. The or each protrusion may be configured to assist a user in separating the first part from the second part.

Where both the first part and the second part comprise a protrusion, the protrusion on the first part may be offset with respect to the protrusion on the second part. Offsetting the protrusions may enable a user to more easily grasp each of the protrusions.

In an embodiment there may be provided a plurality of protrusions, e.g. 1, 2, 3, 4 or 5 protrusions may be provided on one or both of the first part and the second part.

In embodiments, the or each protrusion may be provided on the upstanding wall of one or both of the first part and second part.

In embodiments, the channel-forming means may be integrally formed with one or both of the first part and/or the second part.

In embodiments, the channel-forming means may comprise a portion located within one or both of the first part and/or the second part, which is configured to form a channel on or in the ice luge. In embodiments, the channel-forming means may be configured to form a channel on the external surface of the ice luge.

In embodiments, the channel-forming means may be separable from the first part and/or second part of the mould. In embodiments, the channel-forming means may be removable from the formed ice luge.

In embodiments, the channel-forming means may comprise an elongate body, for example an elongate solid body or tube, e.g. a flexible tube, for example a plastic tube. In embodiments, the channel-forming means may be configured to form a channel internally within the ice luge.

Advantageously, the use of a channel-forming means, e.g. an elongate body or tube, which is removable from the formed ice luge enables the mould to be reused to form multiple ice luges.

In embodiments, the channel-forming means, e.g. an elongate body or tube, may be fabricated from a polymeric material, preferably a food grade polymeric material, for example, one or more of a thermoplastic elastomer (TPE), silicone (e.g. silicone rubber), polyamides (e.g. Nylon), polyethylene (e.g. LDPE), polypropylene, polyethylene terephthalate (PET) and so on.

Whilst the channel-forming means may comprise an elongate solid body it is preferred that it comprises an elongate hollow body (i.e. a tube). It has been found that elongate tubes are easier to remove from the moulded ice due to a tube's ability to change shape when a pulling force is exerted thereon, thereby causing the surface of the tube to move away from the facing surface of the ice.

In embodiments, either or both of the first part and/or the second part may comprise one or more receiving apertures. The one or more receiving apertures may be configured to receive a first end or a second end of a channel-forming means, e.g. a tube. In embodiments, the first part or the second part may comprise a first receiving aperture and a second receiving aperture, wherein the first receiving aperture is positioned towards a first end and the second receiving aperture is positioned towards a second end of the first part or the second part, such that the resulting channel in the ice luge slopes downwardly in use. In embodiments, a first end of a channel-forming means, e.g. a tube, may be located (e.g. removably and/or sealingly located) through the first receiving aperture, and a second end of a channel-forming means, e.g. a tube, may be located (e.g. removably and/or sealingly located) through the second receiving aperture, to form a channel within the ice luge for receiving liquid, in use. In this way, once the channel-forming means has been removed (or if hollow may have been retained) liquid, e.g. a beverage, may be poured into the formed channel of the ice luge at the entrance, and the liquid may flow down through the channel to emerge from the exit of the channel at a lower temperature.

The channel-forming means may be sealingly located within the first part and/or second part. Advantageously, the channel-forming means is sized and configured to seal the first and second receiving aperture in the first part and/or second part, thereby to prevent fluid from egressing during use.

In an embodiment the channel former or channel-forming means is associated with one part of the mould (i.e. the first or the second part of the mould) and the aperture is associated with the other part of the mould (i.e. the second or first part of the mould). This may allow the channel former or channel-forming means to be located closer to the centre of the mould in use. For example, when filling the mould with fluid (e.g. water) the aperture will be uppermost. In order to ensure easier removal of the mould the water may not be filled to overflow the aperture (providing room for the ice to expand upon freezing). Accordingly, the part of the mould associated with the channel-former or channel-forming means may have a larger volume than the part associated with the aperture.

In embodiments, the mould may be fabricated from a flexible material. Alternatively, the mould may be formed from a rigid material. Advantageously, the use of a flexible material enables the ice luge to be more easily removed from the mould without damaging the mould, so that it can be reused. The facing parts of the mould may have a reinforced lip portion. For example the lip portion may be thicker than the body of the mould, and/or may have other reinforcements.

In embodiments, the mould may be fabricated from a polymeric material, for example a food grade polymeric material. The polymeric material may be selected from one or more of a thermoplastic elastomer (TPE) or silicone (e.g. silicone rubber), polyamides (e.g. Nylon), polyethylene (e.g. LDPE), polypropylene, polyethylene terephthalate (PET) and so on.

The mould according to the invention may be shaped to form any suitable three dimensional shape. The shape formed by the first part and the second part may be similar or dissimilar. The mould may comprise decorative projections and/or rebates on its surface to provide an aesthetically pleasing shape or pattern. In embodiments, the mould may be shaped into a novelty item. In embodiments, the mould may be shaped to form an animal or creature, e.g. a dragon. In embodiments, the mould may be shaped to form three dimensional letters or numbers.

In embodiments, the mould may comprise strengthening means and/or stabilising means, for example, on an external surface of one or both of the first part and second part. In embodiments, the strengthening means may comprise upstanding walls configured to provide strength and/or stability to the shaped mould. In embodiments, the stabilising means may comprise one or more, e.g. two or three or more, projections configured to enable the mould lie in a position wherein the seam between the first part and the second part is substantially level.

In embodiments, the mould may have a height, a width and a depth. The height may be greater than the width and/or the depth. The width may be greater than the height and/or the depth. The depth may be smaller than the height and/or the width.

In embodiments, the mould may have a height of up to 800 mm, a width of up to 800 mm, and a depth of up to 800 mm.

In embodiments, the height of the mould may be between 100 mm to 800 mm, or between 200 mm to 700 mm, or between 300 mm to 600 mm, or between 400 mm to 500 mm. In embodiments, the height of the mould may be between any one of 100, 150, 200, 250, 300, 350, 400, 450, 500, 550, 600, 650, 700, or 750 mm to any one of 800, 750, 700, 650, 600, 550, 500, 450, 400, 350, 300, 250, 200, or 150 mm. For example, the height of the mould may be 100, 110, 120, 130, 140, 150, 160, 170, 180, 190, 200, 210, 220, 230, 240, 250, 260, 270, 280, 290, 300, 310, 320, 330, 340 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790 or 800 mm.

In embodiments, the width of the mould may be between 100 mm to 800 mm, or between 200 mm to 700 mm, or between 300 mm to 600 mm, or between 400 mm to 500 mm. In embodiments, the width of the mould may be between any one of 100, 150, 200, 250, 300, 350, 400, 450, 500, 550, 600, 650, 700, or 750 mm to any one of 800, 750, 700, 650, 600, 550, 500, 450, 400, 350, 300, 250, 200, or 150 mm. For example, the width of the mould may be 100, 110, 120, 130, 140, 150, 160, 170, 180, 190, 200, 210, 220, 230, 240, 250, 260, 270, 280, 290, 300, 310, 320, 330, 340 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790 or 800 mm.

In embodiments, the depth of the mould may be between 100 mm to 800 mm, or between 200 mm to 700 mm, or between 300 mm to 600 mm, or between 400 mm to 500 mm. In embodiments, the depth of the mould may be between any one of 100, 150, 200, 250, 300, 350, 400, 450, 500, 550, 600, 650, 700, or 750 mm to any one of 800, 750, 700, 650, 600, 550, 500, 450, 400, 350, 300, 250, 200, or 150 mm. In embodiments, the depth of the mould may be between 50 mm to 600 mm, or between 100 to 550 mm, or between 150 mm to 500 mm, or between 200 mm to 450 mm, or between 250 mm to 400 mm, or between 300 mm to 350 mm. In embodiments, the depth of the mould may be between any one of 50, 100, 150, 200, 250, 300, 350, 400, 450, 500, or 550 mm to any one of 600, 550, 500, 450, 400, 350, 300, 250, 200, 150, or 100 mm. For example, the depth of the mould may be 50, 60, 70, 80, 90, 100, 110, 120, 130, 140, 150, 160, 170, 180, 190, 200, 210, 220, 230, 240, 250, 260, 270, 280, 290, 300, 310, 320, 330, 340 350, 360, 370, 380, 390, 400, 410, 420, 430, 440, 450, 460, 470, 480, 490, 500, 510, 520, 530, 540, 550, 560, 570, 580, 590 or 600 mm.

Advantageously, the mould may be dimensioned such that it can be placed in a domestic freezer for home use of an ice luge.

In use, to form the ice luge, the first part and the complementary second part may be placed together to form a fluid-tight seal, and optionally a separate channel-forming means may be added to the cavity formed between the first part and the second part. The user may then add water to fill the interior of the mould via the inlet. The user may then fasten any securement means to secure the first part and complementary second part of the mould together. The filled mould is then placed in a freezer for sufficient time to freeze the water within the mould. Once the water has frozen, the resulting ice luge may be removed from the mould by separating the first part from the second part. Separating the first part from the second part may comprise grasping a protrusion located on the first part and a protrusion located on the second part and pulling them apart. Optionally, the channel-forming means may be removed from the ice luge to form a channel in the ice luge.

A further aspect of the invention provides a method of fabricating a two-part mould suitable for use in forming an ice luge, the method comprising:

i. forming, e.g. moulding, a first part and a complementary second part, wherein the first part and/or the complementary second part comprise a water inlet and a fluid-tight seal around the internal periphery of one or both of the first and second part;
ii. providing a channel-forming means configured to form a channel (e.g. an internal channel) in the ice luge.

In embodiments, forming, e.g. moulding, a first part and a complementary second part may comprise blow moulding, injection moulding, and/or compression moulding.

In embodiments, forming, e.g. moulding, a first part and a complementary second part may comprise providing one or more protrusions on one or both of the first part and the complementary second part.

In embodiments, forming, e.g. moulding, a first part and a complementary second part may comprise providing one or more securement means on one or both of the first part and the complementary second part.

In embodiments, providing a channel-forming means configured to form a channel in the ice luge may comprise securing a separable channel-forming means to one or both of the first part and/or second part. In embodiments, the channel forming means may comprise or consist of a tube, e.g. a flexible tube, for example, a plastic tube.

In embodiments, providing a channel-forming means configured to form a channel in the ice luge may be performed as part of step i. for example, by providing (e.g. moulding) a channel-forming means that is integrally formed with one or both of the first part and/or the second part.

The method may further comprise locating a channel-forming means within one or more aperture(s) in one or both of the first part and/or the second part. The channel-forming means may be sealingly located within the first part and/or second part. Advantageously, the channel-forming means is sized and configured to seal a first and second receiving aperture in the first part and/or second part, thereby to prevent fluid from egressing during use.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF SEVERAL VIEWS OF THE DRAWINGS

Embodiments of the invention will now be described by way of example only with reference to the accompanying drawings in which.

DETAILED DESCRIPTION OF PREFERRED EMBODIMENTS OF THE INVENTION

Figure 1:
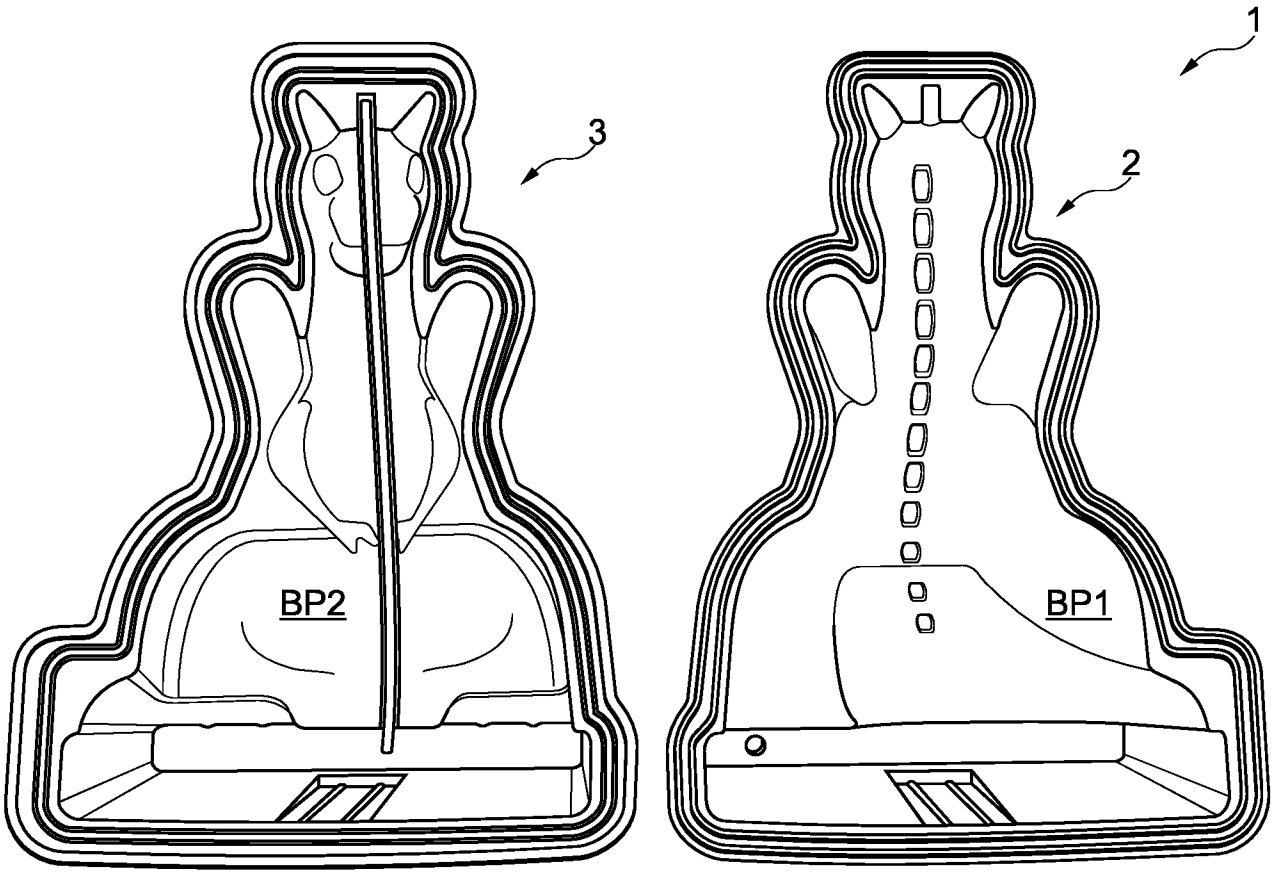
FIG. 1 is a two-part mould for forming an ice luge, according to a first embodiment of the invention.

Referring now to FIG. 1, there is shown a two-part mould 1 suitable for fabricating an ice luge according to a first embodiment of the invention. The mould 1 comprises a first part 2 and a complementary second part 3.

The first part 2 and the second part 3 are configured to form an internal cavity therebetween when assembled.

Figure 2:
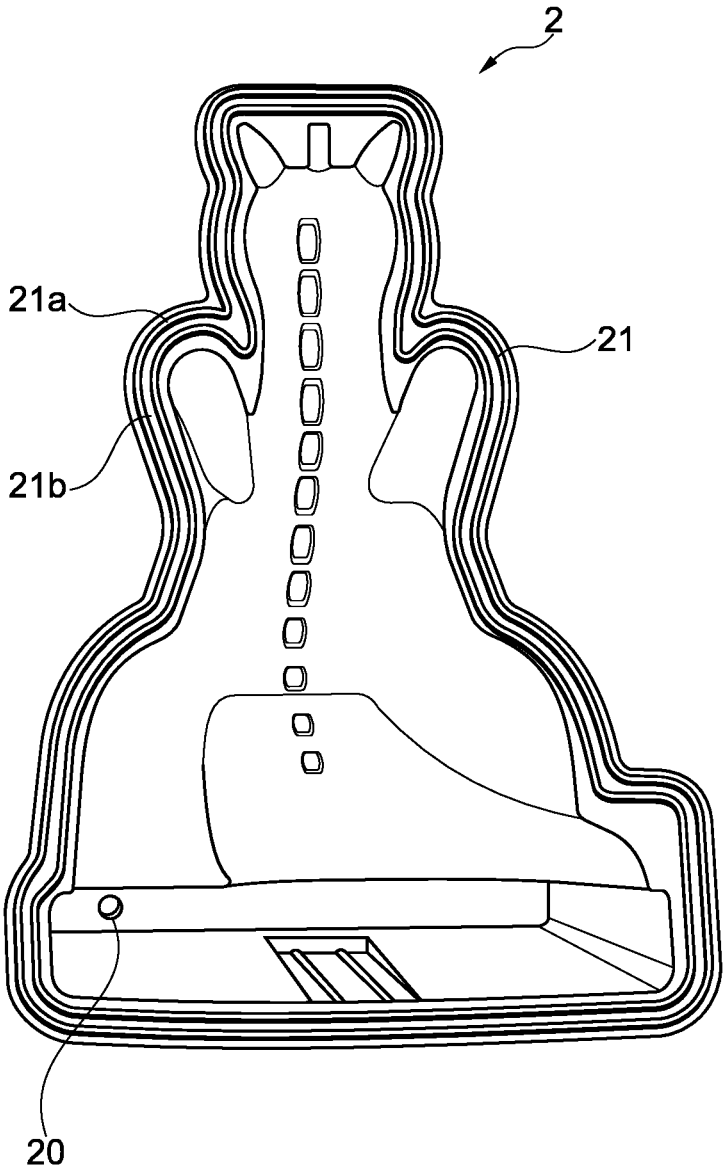
FIG. 2 is the first part of the mould of FIG. 1.

Referring also to FIG. 2, there is shown the first part 2 of the mould 1 in more detail. The first part 2 comprises a water inlet 20. In this embodiment, the first part 2 comprises a male member 21 around the internal periphery of the first part 2. The male member 21 comprises two projections 21*a*, 21*b* in the form of an inner and an outer continuous upstanding male member or rib.

Figure 3:
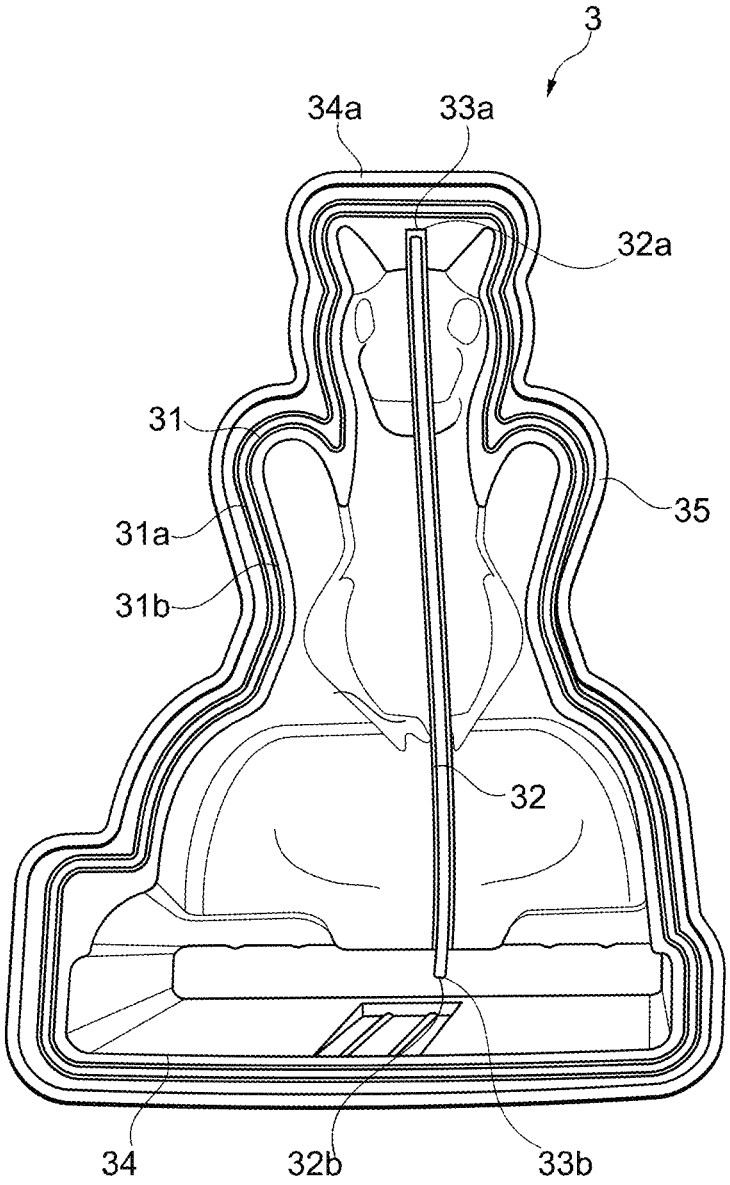
FIG. 3 is the second part of the mould of FIG. 1.

Referring also to FIG. 3, there is shown the second part 3 of the mould 1 in more detail. In this embodiment, the second part 3 comprises a female member 31 around the internal periphery of the second part 3. The female member 31 comprises two rebates 31*a*, 31*b* in the form of an inner and an outer continuous channel.

The two rebates 31*a*, 31*b* of the female member 31 are configured to receive the two projections 21*a*, 21*b* of the male member 21 to form a fluid-tight (e.g. watertight) seal.

Advantageously, the provision of a fluid-tight seal around the (e.g. internal) periphery of the first and second part 2, 3 enables the first part 2 to be separated from the second part 3 without damage. This enables the mould 1 to be reused to form multiple ice luges.

The second part 3 further comprises a channel-forming means 32 configured to form a channel in the ice luge, and a first and second aperture 33*a*, 33*b*. The first aperture 33*a* is located towards a first end 34*a* of the second part 3, and the second aperture 33*b* is located towards a second end 34*b* of the second part 3.

In this embodiment, the channel-forming means 32 comprises a separable plastic tube. The first end 32*a* of the channel-forming means 32 is separably located in the first aperture 33*a* of the second part 3, and the second end 32*b* of the channel-forming means 32 is separably located in the second aperture 33*b* of the second part 3. The channel-forming means 32 is configured to form a channel internally within the formed ice luge.

The second part 3 further comprises an upstanding wall 35, which extends completely around the periphery of the second part 3. Advantageously, the upstanding wall 35 provides a further sealing means to retain water inside the mould 1 before it is frozen.

Figure 4:
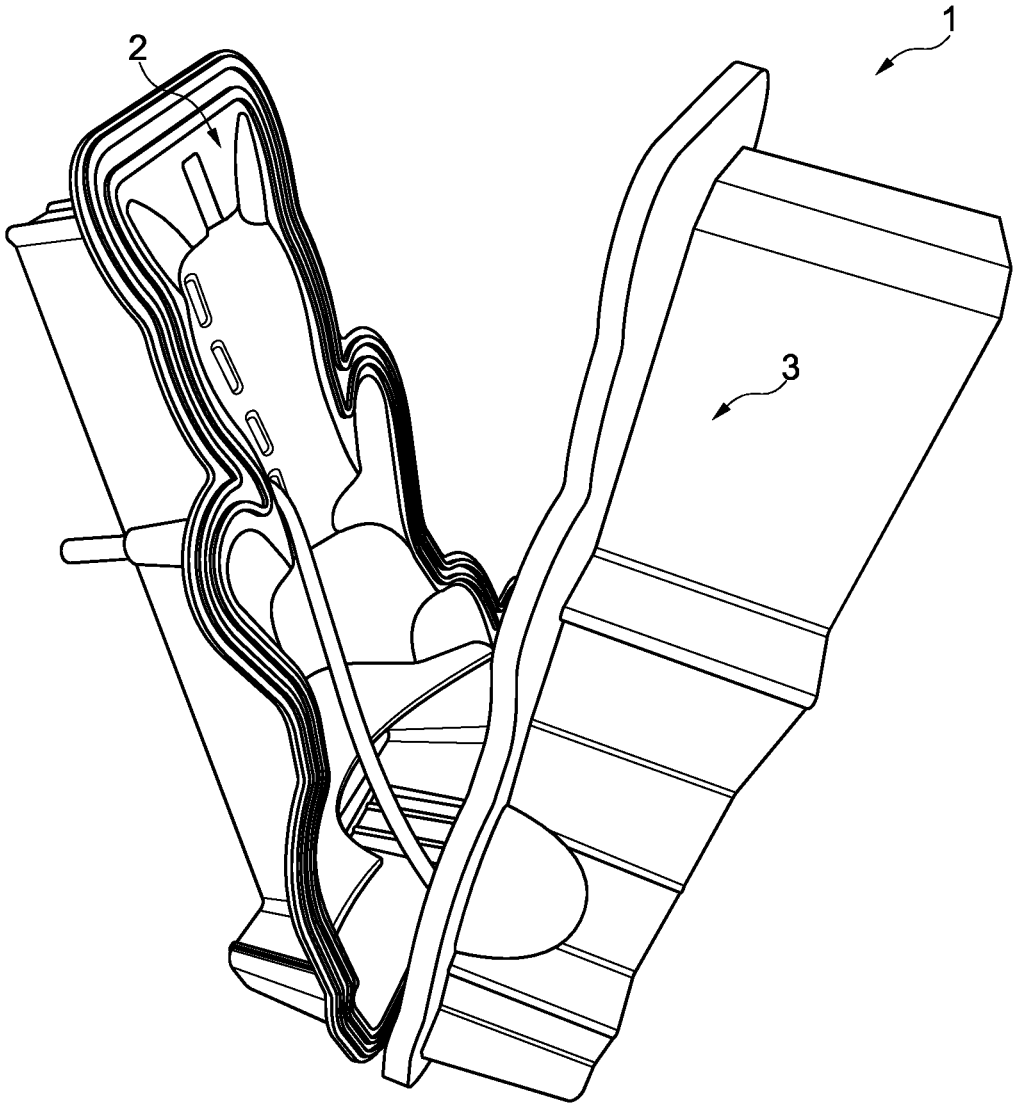
FIG. 4 is the mould of FIG. 1 in an open configuration.

Referring also to FIG. 4, there is shown in the mould 1 comprising the first part 2 and the second part 3 in facing relations. Once closed, a cavity is formed between the first part 2 and the second part 3 for receiving water to form the ice luge. In a closed condition, a seam (not labelled) is formed between the two parts 2, 3.

Each of the first part 2 and the second part 3 comprise shaped body portions (BP1 and BP2 respectively) to define the shape of the ice luge.

Figure 5:
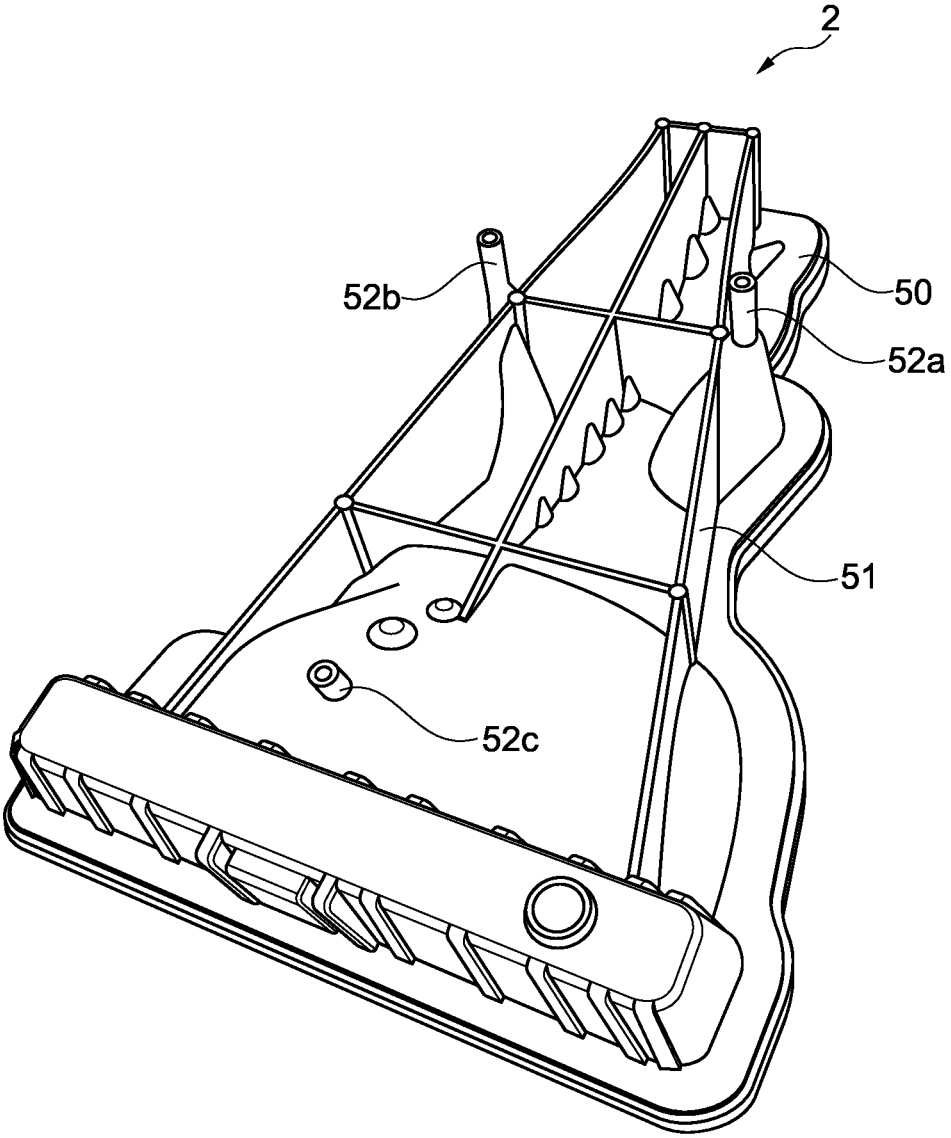
FIG. 5 is the exterior surface of the first part shown in FIG. 2.

Referring also to FIG. 5, there is shown the external surface 50 of the first part 2 of the mould 1. The external surface 50 of the first part 2 comprises strengthening means 51 and stabilising means 52.

The strengthening means 51 comprise upstanding walls configured to provide strength and/or stability to the mould 1.

The stabilising means 52 comprise three projections 52*a*, 52*b*, 52*c* configured to enable the mould 1 lie in a position wherein the seam (not shown) between the first part 2 and the second part 3 is substantially level.

The mould 1 has a height of approximately 360 mm, a width of approximately 270 mm, and a depth of approximately 160 mm. Advantageously, the mould 1 of this embodiment is dimensioned such that it can be placed in a domestic freezer for home use of an ice luge.

In use, to form the ice luge, the first end of the channel-forming means 32*a* is located in the first aperture 33*a* of the second part 3, and the second end 32*b* of the channel-forming means 32 is located in the second aperture 33*b* of the second part 3. The first part 2 and the complementary second part 3 are placed together as shown in FIG. 4, and are closed to form a cavity therebetween. A fluid-tight seal is formed when the two rebates 31*a*, 31*b* of the female member 31 of the second part 3 are received within the two projections 21*a*, 21*b* of the male member 21 of the first part 2. The user then adds water to fill the cavity formed between the first part 2 and the second part 3 of the mould 1 via the water inlet 20. The filled mould 1 is then placed in a freezer for sufficient time to freeze the water within the mould. Once the water has frozen, the resulting ice luge may be removed from the mould 1 by separating the first part 2 from the second part 3. The channel-forming means 32 is also removed from the ice luge to form a channel in the ice luge.

Figure 6:
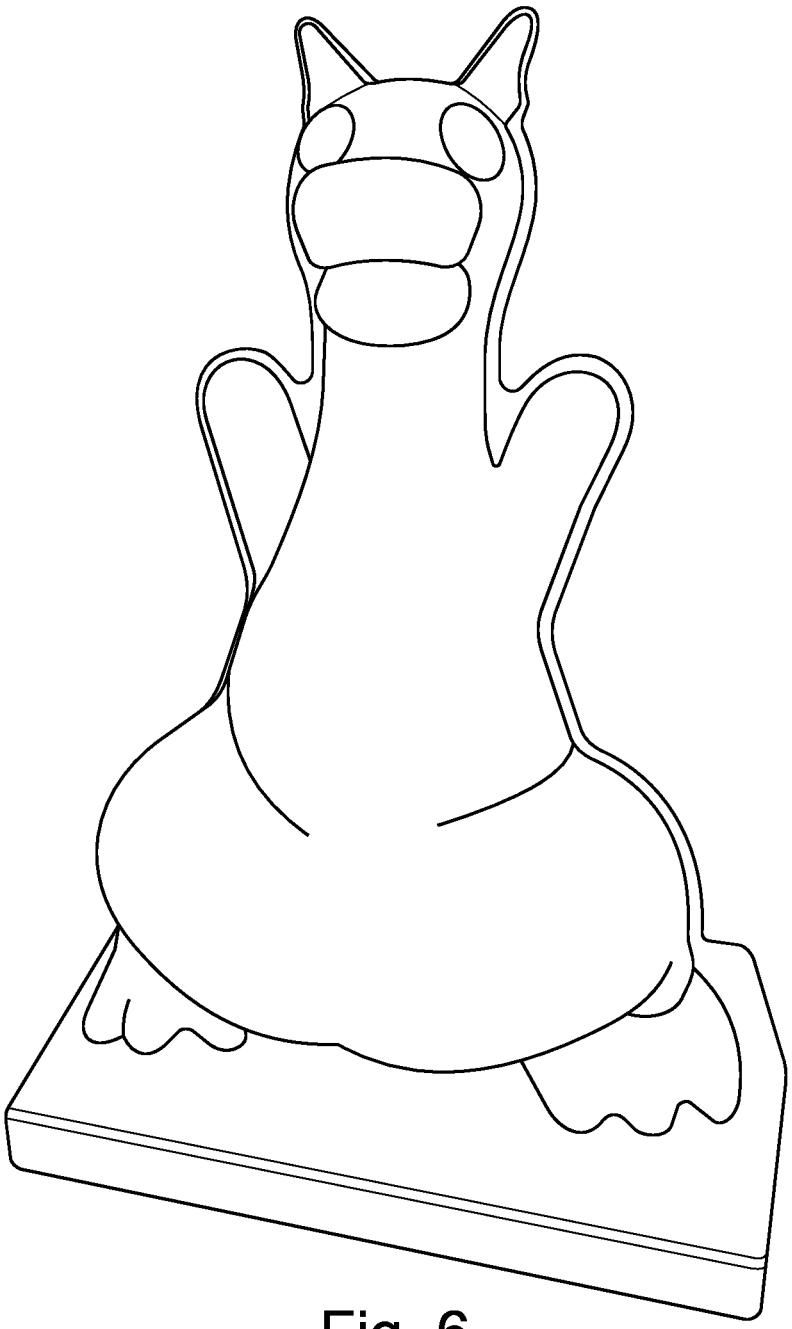
FIG. 6 is the ice luge formed using the two-part mould of FIG. 1.

Referring now to FIG. 6, there is shown an ice luge formed from the mould 1 of FIG. 1. The ice luge is formed in the shape of a dragon, corresponding to the body portions BP1, BP2 of the first part 2 and second part 3 of the mould 1.

Referring now to FIGS. 7 to 13, there is shown a two-part mould 101 suitable for fabricating an ice luge according to a second embodiment of the invention. The mould 101 comprises a first part 102 having a first body part BP1' and a complementary second part 103 having a second body part BP2'.

The first part 102 and the second part 103 are configured to form an internal cavity therebetween when assembled.

Figure 7:
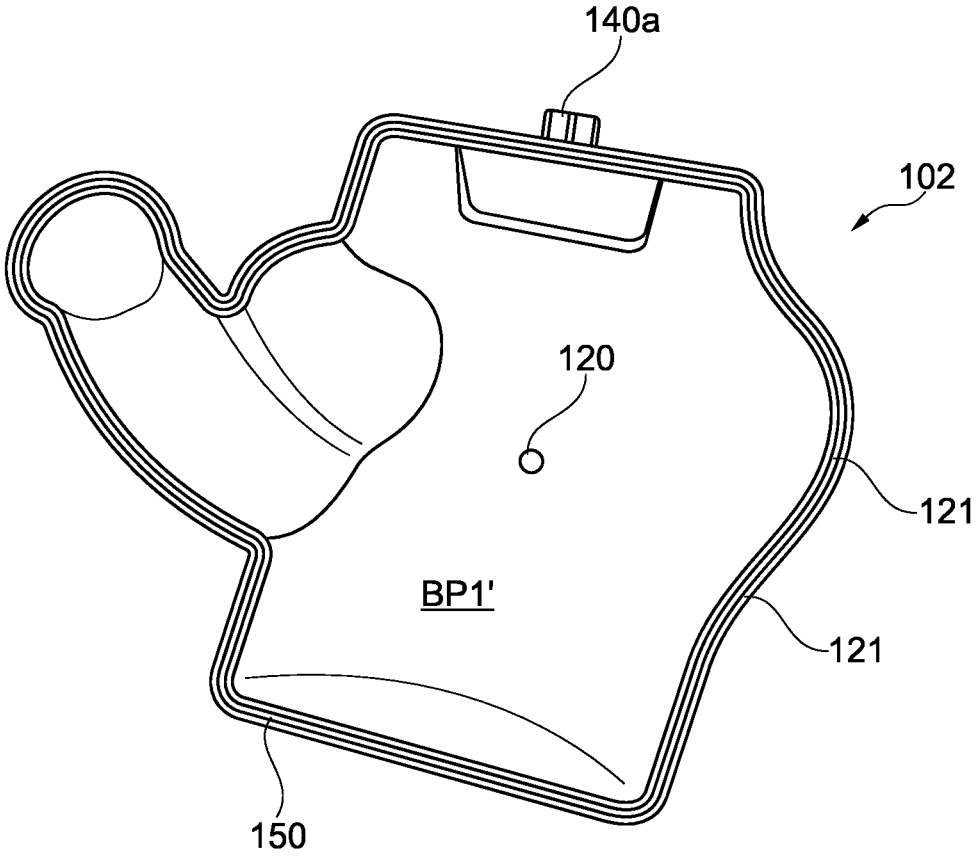
FIG. 7 is a first part of a mould according to a second embodiment of the invention.
Figure 8:
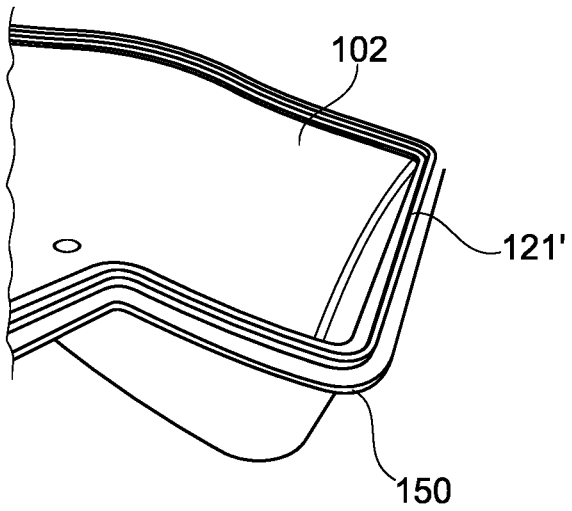
FIG. 8 is a detail of the mould of FIG. 7.

Referring to FIGS. 7 and 8, there is shown the first part 102 of the mould 101. The first part 102 comprises a water inlet 120. In this embodiment, the first part 102 comprises a male member 121 around the internal periphery of the first part 2. The male member 121 comprises a single projection in the form of a continuous upstanding rib. The male member 121 comprises a TPE 121' located on its free edge.

The first part 102 further comprises a rim 150 extending around its external periphery.

The first part 102 further comprises a protrusion 140*a*. The protrusion 140*a* is configured to be grasped by a user to assist in separating the first part 102 from the second part 103.

Figure 9:
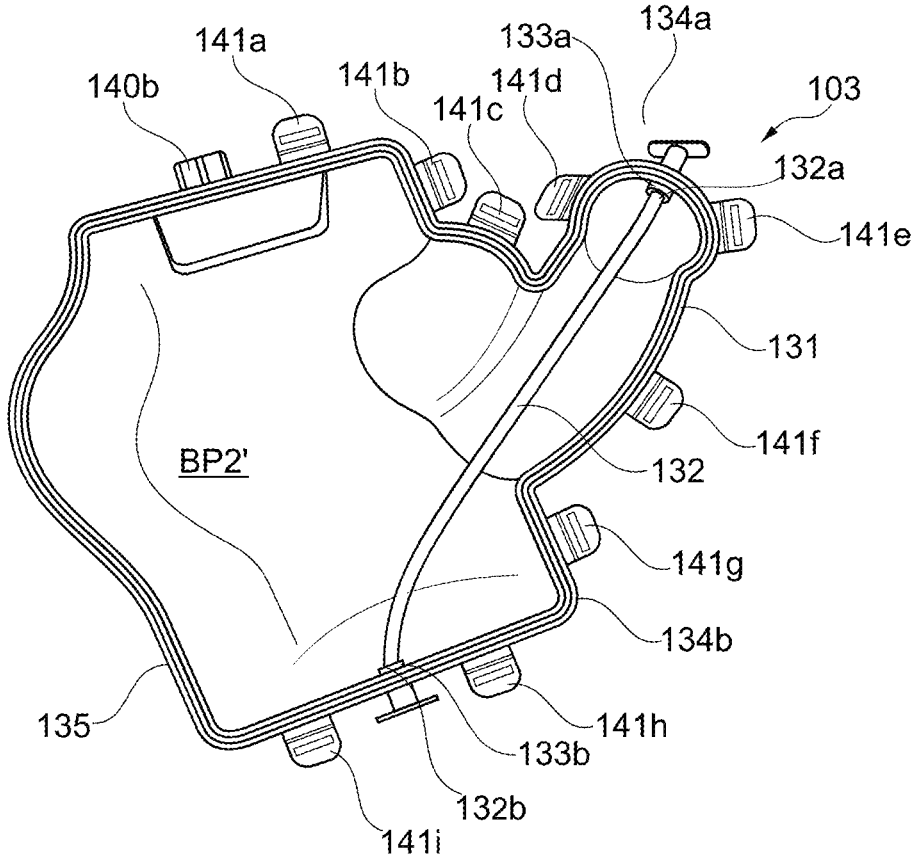
FIG. 9 is a second part of a mould according to the second embodiment of the invention.

Referring to FIG. 9, there is shown the second part 103 of the mould 101. In this embodiment, the second part 103 comprises a female member 131 around the internal periphery of the second part 103. The female member 131 comprises a single rebate in the form of a continuous channel. As shown the channel does not comprise a TPE although one may be present.

The rebate of the female member 131 is configured to be received within the projection of the male member 121 to form a fluid-tight (e.g. watertight) seal.

Advantageously, the provision of a fluid-tight seal around the (e.g. internal) periphery of the first and second part 102, 103 enables the first part 102 to be separated from the second part 103 without damage. This enables the mould 101 to be reused to form multiple ice luges.

Additionally, the second part 103 further comprises a protrusion 140*b*. The protrusion 140*b* is configured to be grasped by a user to assist in separating the second part 103 from the first part 102.

Figure 10:
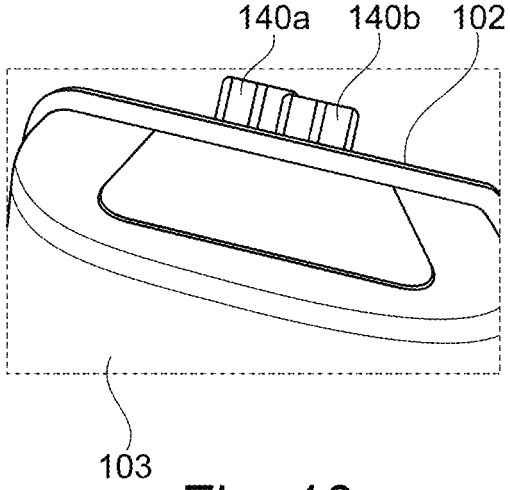
FIG. 10 is a detailed view of the mould of the second embodiment.

Referring to FIG. 10, wherein the first and second parts 102, 103 are shown in facing relations, the protrusion 140*b* on the second part 103 may be offset with respect to the protrusion 140*a* on the first part 102. Offsetting the protrusions 140*a*, 140*b* enables a user to more easily grasp each of the protrusions 140*a*, 140*b*.

By grasping the protrusion 140*a* on the first part 102 and the protrusion 104*b* on the second part 103, a user is able to easily pull apart the first 102 and second 103 parts of the mould 101.

The second part 103 further comprises a channel-forming means 132 configured to form a channel in the ice luge, and a first and second aperture 133*a*, 133*b*. The first aperture 133*a* is located towards a first end 134*a* of the second part 103, and the second aperture 133*b* is located towards a second end 134*b* of the second part 103.

Figure 11:
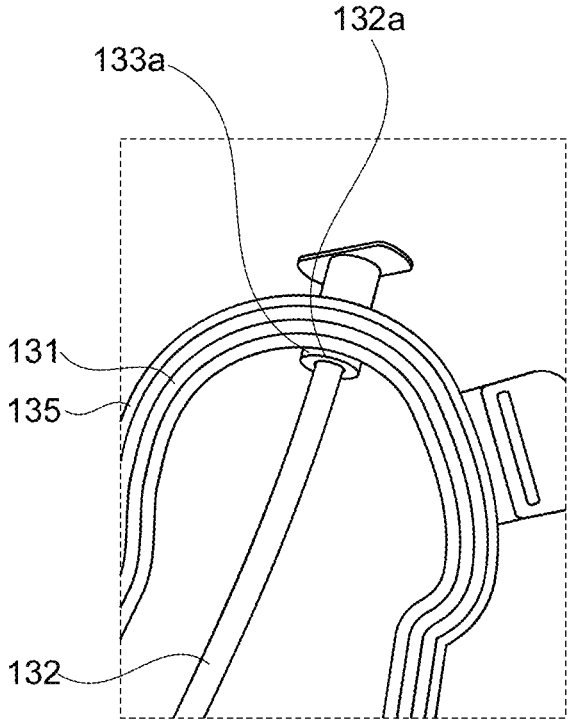
FIGS. 11 and 12 are detailed views mould of the second embodiment.
Figure 12:
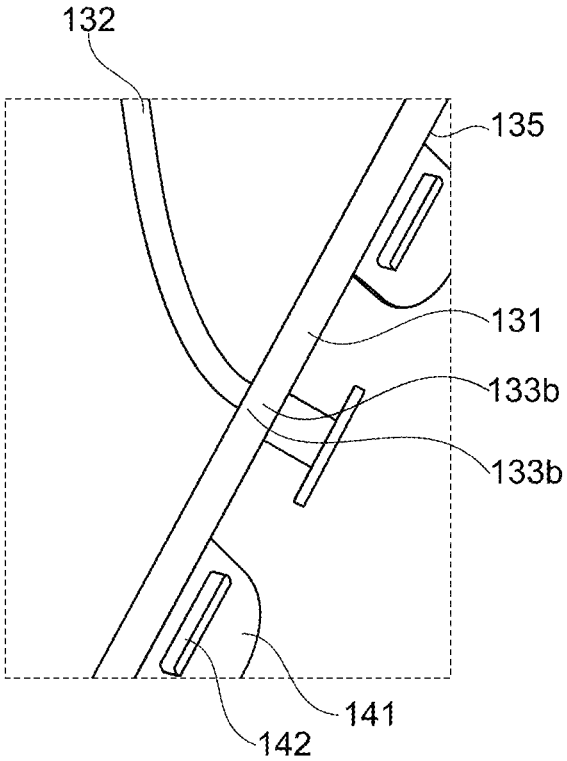

Referring to FIGS. 11 and 12, there is shown the second part 103 of the mould 101 in more detail.

In this embodiment, the channel-forming means 132 comprises a flexible body, for example a flexible tube, preferably formed by silicone rubber. The first end 132*a* of the channel-forming means 132 is separably located in or in communication with the first aperture 133*a* of the second part 103, and the second end 132*b* of the channel-forming means 132 is separably located in or in communication with the second aperture 133*b* of the second part 103. The channel-forming means 132 is configured to form a channel internally within formed the ice luge.

The second part 103 further comprises an upstanding wall 135, which extends completely around the periphery of the second part 103. Advantageously, the upstanding wall 135 provides a further sealing means to retain water inside the mould 101 before it is frozen.

The second part 103 further comprises clips 141. The clips 141 are located on the upstanding wall 135 of the second part 103. In this embodiment there are 9 clips 141*a* to 141*i* (shown in FIG. 9). Each of the clips 141 comprises a male protruding member 142. Each male protruding member 142 is configured to fasten over the rim 150, that extends around the external periphery of the first part 102.

Figure 13:
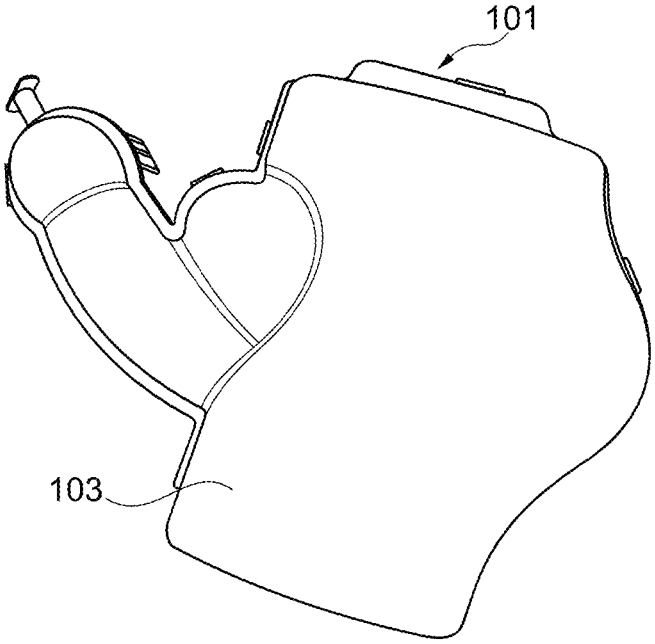
FIG. 13 shows the mould of the second embodiment.

Referring also to FIG. 13, there is shown the exterior surface of the second part 103, wherein the first part 102 and the second part 103 of the mould 101 are in facing relations and wherein the clips 141 on the second part 103 are fastened over the rim 150 of the first part 101.

Once closed, a cavity is formed between the first part 102 and the second part 103 for receiving water to form the ice luge. In a closed condition, a seam (not labelled) is formed between the two parts 102, 103.

The mould 101 has a height of approximately 360 mm, a width of approximately 270 mm, and a depth of approximately 160 mm. Advantageously, the mould 101 of this embodiment is dimensioned such that it can be placed in a domestic freezer for home use of an ice luge.

In use, to form the ice luge, the first end of the channel-forming means 132*a* is located in (or at least is located to communicate with) the first aperture 133*a* of the second part 103, and the second end 132*b* of the channel-forming means 132 is located in (or at least is located to communicate with) the second aperture 133*b* of the second part 103. The first part 102 and the complementary second part 103 are placed together, and are closed to form a cavity therebetween. A fluid-tight seal is formed when the rebate of the female member 131 of the second part 103 is received within the projection of the male member 121 of the first part 102. The user then fastens the clips 141 to further secure the first and second parts 12, 103 of the mould 101 together. The user then adds water to fill the cavity formed between the first part 102 and the second part 103 of the mould 101 via the water inlet 120. The filled mould 101 is then placed in a freezer, with the water inlet 120 facing upwards, for sufficient time to freeze the water within the mould. Once the water has frozen, the resulting ice luge may be removed from the mould 101. The user may grasp the protrusions 140*a*, 140*b* and pull them apart so as to separate the first part 102 from the second part 103. The channel-forming means 132 is removed from the ice luge to form a channel in the ice luge.

It will be appreciated by those skilled in the art that several variations to the aforementioned embodiments are envisaged without departing from the scope of the invention. For example, the shape and dimensions of the ice luge is not limited to that shown in the Figures.

It will also be appreciated by those skilled in the art that any number of combinations of the aforementioned features and/or those shown in the appended drawings provide clear advantages over the prior art and are therefore within the scope of the invention described herein.

What is claimed is:

1. A reusable ice luge mould, the reusable mould comprising a first part and a second part, the first part and the second part being complementary and configured to form an internal cavity therebetween when assembled, the reusable mould further comprising a water inlet and a fluid-tight seal provided around the periphery of the first and second part and a channel former extending between the first part and the second part and configured to form a channel internally within the ice luge.

2. The ice luge mould according to claim 1, wherein the fluid-tight seal is provided around the internal periphery of the first and second part.

3. The ice luge mould according to claim 1, wherein the channel former comprises a tube.

4. The ice luge mould according to claim 1, wherein either or both of the first part and/or the second part comprise one or more apertures configured to receive a first end or a second end of the channel former.

5. The ice luge mould according to claim 1, wherein the water inlet comprises an aperture located in one of the first part or the second part.

6. The ice luge mould according to claim 1, wherein the water inlet comprises a valve and the valve may be configured to allow water to enter but not to exit the cavity formed between the first part and the second part of the mould.

7. The ice luge mould according to claim 1, wherein the fluid-tight seal comprises a male member and a female member.

8. The ice luge mould according to claim 7, wherein the male member comprises one or more projections that extend around the periphery, and wherein the female member comprises one or more rebates that extend around the periphery, wherein the rebates of the female member may be sized and shaped to receive the projections of the male member.

9. The ice luge mould according to claim 8 wherein the male member and/or the female member comprises a seal material.

10. The ice luge mould according to claim 1, wherein one or both of the first part and the second part comprise an upstanding wall that extends at least partially around the periphery of one or both of the first part and second part.

11. The ice luge mould according to claim 1, wherein one or both of the first part and the second part comprise one or more securements to further secure the first part of the mould to the second part of the mould.

12. The ice luge mould according to claim 1, wherein one or both of the first part and the second part comprise a protrusion(s) configured to assist a user in separating the first part from the second part.

13. The ice luge mould according to claim 1, further comprising a strengthener.

14. The ice luge mould according to claim 1, further comprising a stabiliser.

15. The ice luge mould according to claim 1, wherein the mould is dimensioned such that it can be placed in a domestic freezer for home use of an ice luge.

16. A method of manufacturing an ice luge, the method comprising:

i. providing a mould according to claim 1;
ii. placing the first part and the complementary second part together to form a fluid-tight seal;
iii. adding water to fill the interior of the mould via the inlet;
iv. placing the filled mould in a freezer for a sufficient time to freeze the water within the mould; and
v. removing the resulting ice luge from the mould by separating the first part from the second part once the water has frozen.

17. A method according to claim 16, wherein step (i) further comprises adding a separate channel former to the cavity formed between the first part and the second part.

18. A method according to claim 17, further comprising step (vi) removing the separate channel former from the ice luge to form a channel in the ice luge.

19. A method of fabricating a two-part reusable mould for use in forming an ice luge, the method comprising:

i. forming a first part and a complementary second part, wherein the first part and/or the complementary second part comprise a water inlet and a fluid-tight seal around the periphery of one or both of the first and second part; and
ii. providing a channel former configured to form a channel internally within the ice luge.

20. The method according to claim 19, further comprising locating the channel former within one or more aperture(s) in one or both of the first part and/or the second part.

* * * * *